US007126570B2

(12) United States Patent
Naito

(10) Patent No.: US 7,126,570 B2
(45) Date of Patent: Oct. 24, 2006

(54) LIQUID CRYSTAL DEVICE, IMAGE PROCESSING DEVICE, IMAGE DISPLAY APPARATUS WITH THESE DEVICES, SIGNAL INPUT METHOD, AND IMAGE PROCESSING METHOD

(75) Inventor: Keijiro Naito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 383 days.

(21) Appl. No.: 10/068,879

(22) Filed: Feb. 11, 2002

(65) Prior Publication Data

US 2002/0118156 A1 Aug. 29, 2002

(30) Foreign Application Priority Data

Feb. 27, 2001 (JP) ..... 2001-052198

(51) Int. Cl.
*G09G 3/36* (2006.01)

(52) U.S. Cl. ..... 345/87; 345/90; 345/95; 345/98; 345/100

(58) Field of Classification Search ..... 345/87–103, 345/204–215
See application file for complete search history.

(56) References Cited

U.S. PATENT DOCUMENTS 4,455,576 A * 6/1984 Hoshi ..... 348/792
5,764,210 A * 6/1998 Moon ..... 345/90
5,949,391 A * 9/1999 Saishu et al. ..... 345/50
6,243,064 B1 * 6/2001 Hirakata ..... 345/96
6,407,728 B1 * 6/2002 Sekine ..... 345/90
6,456,266 B1 * 9/2002 Iba et al. ..... 345/87
6,756,954 B1 * 6/2004 Yamamoto et al. ..... 345/87

FOREIGN PATENT DOCUMENTS

JP 04-109218 4/1992
JP 06-089073 3/1994

* cited by examiner

*Primary Examiner*—Vijay Shankar
(74) *Attorney, Agent, or Firm*—Oliff & Berridge, PLC

(57) ABSTRACT

A liquid crystal device having multiple pixels includes an input terminal that receives a display signal including multiple pixel signals to be supplied to the multiple pixels. The display signal has a predetermined signal embedded therein for generating a common signal, which is to be commonly supplied to the multiple pixels, during a predetermined period that does not include the pixel signals in the display signal. The liquid crystal device further includes: a common signal line that is commonly connected to the multiple pixels; and a common signal line driving circuit that generates the common signal in response to the predetermined signal included in the display signal input from the input terminal and supplies the generated common signal to the common signal line. Such arrangement desirably enhances the reliability of the liquid crystal device.

11 Claims, 9 Drawing Sheets

(a) HRST
(b) HCLK
(c) VDT
(d) VDATA
(e) VINV
(f) VIN
Horizontal Scanning Period 6H
7H
Effective Horizontal Scan Period EH
1T
2T
3T
4T
5T
(3+m)T
(4+m)T
Pixel Period T
P1
P2
P
Pm
COM
Negative
Positive
VCOM(200)
(Vc+Vf)
Vc
(Vc−Vf)
0
(Vc+Vf) : White Level of Positive Polarity (511)
(Vc) : Black Level (255)
(Vc−Vf) : White Level of Negative Polarity ( 0)

LIQUID CRYSTAL DEVICE, IMAGE PROCESSING DEVICE, IMAGE DISPLAY APPARATUS WITH THESE DEVICES, SIGNAL INPUT METHOD, AND IMAGE PROCESSING METHOD

BACKGROUND OF THE INVENTION

1. Field of the Invention

The present invention relates to a technique of generating a common signal that is commonly supplied to respective pixels of a liquid crystal device.

2. Description of the Related Art

A liquid crystal panel is widely used as an optoelectric device for generating images. The liquid crystal panel is an optoelectric device that applies a voltage corresponding to a display signal to liquid crystal forming respective pixels and regulates the light transmittance of each pixel, so as to generate an image in response to the display signal.

In the prior art liquid crystal panel, a common signal representing a standard level of the display signal is input via an exclusively provided input terminal, separately from the display signal. An electronic apparatus, such as an image display apparatus, with the prior art liquid crystal panel, accordingly has a common signal generation circuit for generating the common signal.

Different offset values depending on respective devices are set to the level of the common signal. The common signal generation circuit is thus constructed to enable adjustment of the level of the common signal according to the generated offset.

In order to enhance the reliability of the liquid crystal panel and reduce the manufacturing cost, however, it is desirable to reduce the total number of input terminals for receiving externally supplied signals.

In order to enhance the reliability of the electronic apparatus with the liquid crystal panel, reduce the size of the electronic apparatus, simplify the structure of the electronic apparatus, and reduce the manufacturing cost, it is also desirable to omit the common signal generation circuit.

SUMMARY OF THE INVENTION

The object of the present invention is thus to provide a technique that enhances the reliability of a liquid crystal panel, as well as enhances the reliability of an electronic apparatus with the liquid crystal panel, reduces the size of the electronic apparatus, simplifies the structure of the electronic apparatus, and reduces the manufacturing cost.

At least part of the above and the other related objects is attained by a liquid crystal device having multiple pixels. The liquid crystal device includes an input terminal that receives a display signal including multiple pixel signals to be supplied to the multiple pixels, the display signal having a predetermined signal embedded therein for generating a common signal, which is to be commonly supplied to the multiple pixels, during a predetermined period that does not include the pixel signals in the display signal.

The liquid crystal device of the present invention inputs the display signal with the predetermined signal embedded therein. The predetermined signal, which is used for generating the common signal to be commonly supplied to the multiple pixels, is embedded in the display signal that includes the multiple pixel signals to be given to the multiple pixels. This arrangement allows omission of the input terminal exclusively provided for inputting the common signal in the prior art liquid crystal device, thus desirably enhancing the reliability of the liquid crystal device.

It is desirable that the predetermined period is part of a horizontal scanning period except an effective horizontal scan period. It is also desirable that the predetermined period is part of a vertical scanning period except an effective vertical scan period.

Either of the above periods does not include the multiple pixel signals in the display signal, so that the predetermined signal for generating the common signal can readily be embedded in the display signal.

In accordance with one preferable application of the present invention, the liquid crystal device further includes: a common signal line that is commonly connected to the multiple pixels; and a common signal line driving circuit that generates the common signal in response to the predetermined signal included in the display signal input from the input terminal and supplies the generated common signal to the common signal line.

In this application, the common signal line driving circuit functions to readily supply the common signal to the multiple pixels via the common signal line.

The common signal line driving circuit may be a sample/hold circuit that samples the predetermined signal included in the display signal input from the input terminal and outputs the predetermined sampled signal as the common signal.

In accordance with one preferable embodiment, the liquid crystal device further has: multiple rows of scanning lines and multiple columns of signal lines for selecting the multiple pixels; a scanning line driving circuit that supplies scanning signals to the corresponding multiple rows of scanning lines in a sequence of the multiple rows of scanning lines; and a signal line driving circuit that samples display signals corresponding to the multiple columns of signal lines in a sequence of the multiple columns of signal lines and supplies the sampled display signals to the corresponding signal lines. The signal line driving circuit supplies a sample/hold signal, which is used for sampling the predetermined signal, to the common signal line driving circuit.

This arrangement enables the sample/hold signal, which is used for sampling the predetermined signal, to be readily supplied to the common signal line driving circuit during part of a horizontal scanning period except an effective horizontal scan period.

In accordance with another preferable embodiment, the liquid crystal device further has: multiple rows of scanning lines and multiple columns of signal lines for selecting the multiple pixels; a scanning line driving circuit that supplies scanning signals to the corresponding multiple rows of scanning lines in a sequence of the multiple rows of scanning lines; and a signal line driving circuit that samples display signals corresponding to the multiple columns of signal lines in a sequence of the multiple columns of signal lines and supplies the sampled display signals to the corresponding signal lines. The scanning line driving circuit supplies a sample/hold signal, which is used for sampling the predetermined signal, to the common signal line driving circuit.

This arrangement enables the sample/hold signal, which is used for sampling the predetermined signal, to be readily supplied to the common signal line driving circuit during part of a vertical scanning period except an effective vertical scan period.

The present invention is also directed to an image processing device that generates a display signal, which is to be input into a liquid crystal device having multiple pixels. The image processing device includes: a video signal conversion circuit that converts an input video signal and generates multiple pixel signals, which are to be given to the multiple pixels of the liquid crystal device; and a display signal generation circuit that combines the multiple pixel signals with a predetermined signal, which is used for generating a common signal to be commonly supplied to the multiple pixels, and thereby generates one display signal.

The image processing device of the present invention readily generates the display signal, which is to be input into the liquid crystal device of the present invention.

The present invention is further directed to an image display apparatus, which includes: a liquid crystal device having multiple pixels; and an image processing device that generates a display signal, which is to be input into the liquid crystal device. The liquid crystal device has an input terminal that receives the display signal including multiple pixel signals to be supplied to the multiple pixels, the display signal having a predetermined signal embedded therein for generating a common signal, which is to be commonly supplied to the multiple pixels, during a predetermined period that does not include the pixel signals in the display signal. The image processing device includes: a video signal conversion circuit that converts an input video signal and generates the multiple pixel signals, which are to be given to the multiple pixels of the liquid crystal device; and a display signal generation circuit that combines the multiple pixel signals with a predetermined signal, which is used for generating a common signal to be commonly supplied to the multiple pixels, and thereby generates one display signal.

The image display apparatus of the present invention includes the liquid crystal device and the image processing device of the present invention. The enhanced reliability of the liquid crystal device leads to enhancement of the reliability of the image display apparatus. This arrangement also enables omission of the common signal generation circuit, which is required in the prior art image display apparatus. This enhances the reliability of the image display apparatus, reduces the size of the image display apparatus, simplifies the structure of the image display apparatus, and reduces the manufacturing cost.

In accordance with one preferable application of the image display apparatus, the image processing device further includes an adjustment control circuit that adjusts a value of data included in the predetermined signal.

This arrangement enables the value of the common signal, which varies depending upon the liquid crystal device, to be readily adjusted.

The technique of the present invention may be actualized in a diversity of applications other than the liquid crystal device, the image processing device, and the image display apparatus discussed above; for example, a method of inputting the predetermined signal, which is used for generating the common signal to be commonly supplied to multiple pixels of the liquid crystal device, and an image processing method to generate the display signal that is to be input into the liquid crystal device.

DESCRIPTION OF THE PREFERRED EMBODIMENTS

Figure 1:
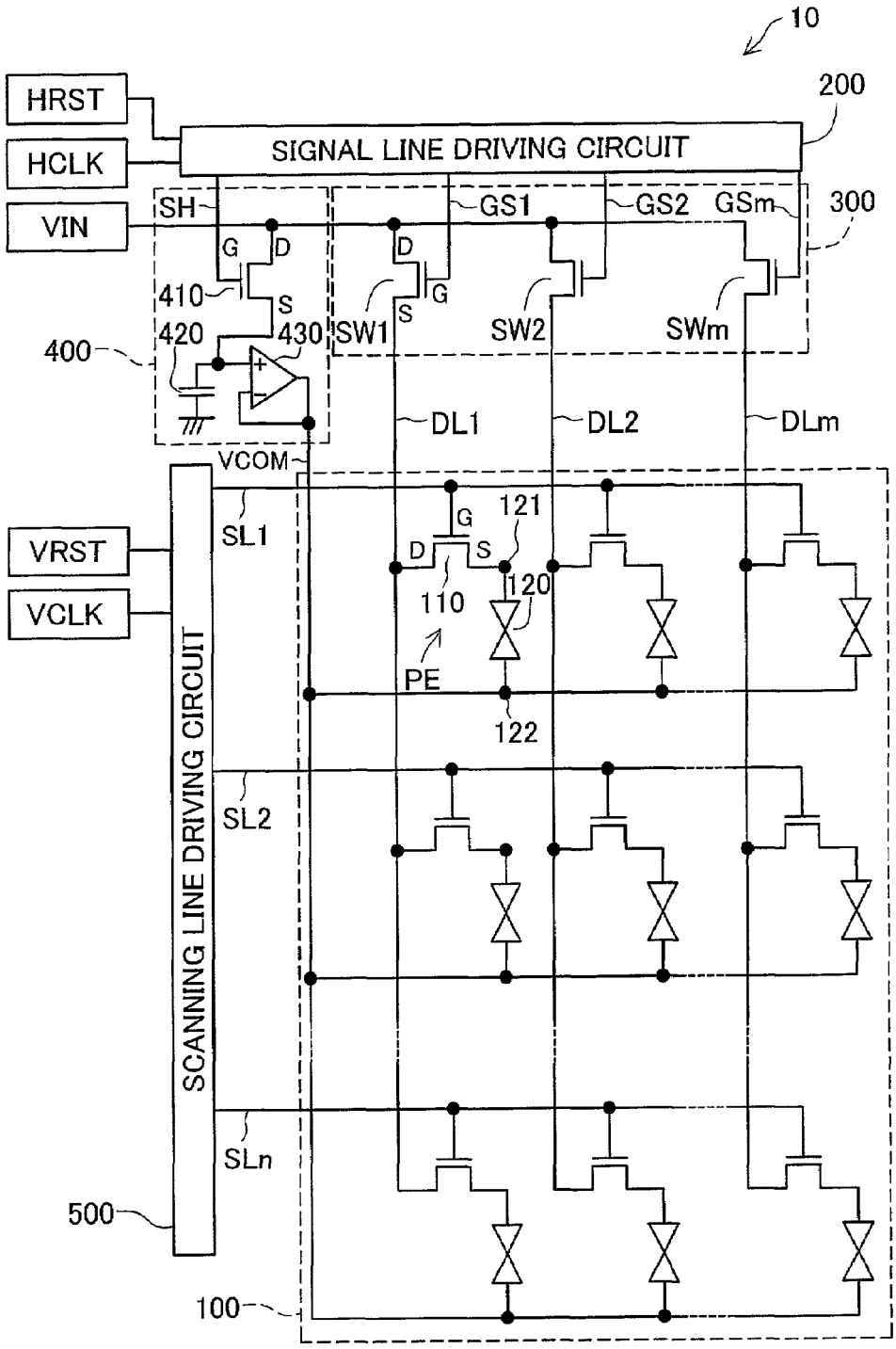
FIG. 1 is a circuit diagram schematically illustrating the electric structure of a liquid crystal panel 10 in a first embodiment of the present invention.

Some modes of carrying out the present invention are discussed below as preferred embodiments in the following sequence:

A. Construction and Operations of Liquid Crystal Panel
  A1. First Embodiment of Liquid Crystal Panel
  A2. Second Embodiment of Liquid Crystal Panel
B. Construction and Operations of Image Display Apparatus with Liquid Crystal Panel
  B1. First Embodiment of Image Display Apparatus
  B2. Second Embodiment of Image Display Apparatus
C. Modifications A. Structure and Operations of Liquid Crystal Panel A1. First Embodiment of Liquid Crystal Panel FIG. 1 is a circuit diagram schematically illustrating the electric structure of a liquid crystal panel 10 in a first embodiment of the present invention. The liquid crystal panel 10 includes an image display module 100, a signal line driving circuit 200, a sampling circuit 300, a common signal line driving circuit 400, and a scanning line driving circuit 500. The liquid crystal panel 10 has input terminals to receive an analog display signal VIN as well as a vertical synchronizing signal VRST, a horizontal synchronizing signal HRST, a vertical clock signal VCLK, and a horizontal clock signal HCLK as timing signals. Circuits that are not essential elements of the present invention, such as a precharge circuit, and input terminals, such as a power input terminal, are omitted from the illustration of the liquid crystal panel 10. In the description below, identical symbols are allocated to input terminals, signal lines, and signals.

The image display module 100 has matrix wiring consisting of 'n' (where 'n' is an integer of not less than 2) scanning lines SL (SL1 to SLn) running in a horizontal direction and 'm' (where 'm' is an integer of not less than 2) signal lines DL (DL1 to DLm) running in a vertical direction. Pixels PE are provided on respective intersections in the matrix wiring.

Each pixel PE of the image display module 100 includes a TFT (Thin Film Transistor) 110 for pixel selection and a liquid crystal pixel 120 having a liquid crystal cell (not shown). A gate electrode (G) of the TFT 110 is connected to the corresponding scanning line SL and a drain electrode (D)

is connected to the corresponding signal line DL, while a source electrode (S) is connected to a pixel electrode 121 of the liquid crystal pixel 120. The liquid crystal pixel 120 includes the pixel electrode 121, a common electrode 122, and liquid crystal interposed between the pixel electrode 121 and the common electrode 122. The common electrode 122 is connected to a common signal line VCOM. All the pixels PE arrayed in 'n' lines by 'm' columns are accordingly connected to the common signal line VCOM via the common electrodes 122 of the liquid crystal pixels 120.

The 'n' rows of scanning lines SL are connected to the scanning line driving circuit 500. The 'm' columns of signal lines DL are connected to a display signal line VIN via the sampling circuit 300. The common signal line VCOM is connected to the display signal line VIN via the common signal line driving circuit 400.

The sampling circuit 300 is provided with switches SW (SW1 to SWm) corresponding to the respective data lines DL. Each switch SW is constructed by a semiconductor element, such as a TFT. A drain electrode (D) of each switch SW is commonly connected to the display signal line VIN and each source electrode (S) is connected to the corresponding signal line DL, while each gate electrode (G) is connected to the signal line driving circuit 200 via a corresponding sampling signal line GS (GS1 to GSm). The sampling circuit 300 functions to sample the display signal VIN and supply the sampled display signal VIN to each signal line DL, in response to each sampling signal GS transmitted from the signal line driving circuit 200.

The common signal line driving circuit 400 is a sample/hold circuit including a switch 410, a capacitor 420, and a buffer amplifier 430. Like the switch SW of the sampling circuit 300, the switch 410 is constructed by a semiconductor element. A drain electrode (D) of the switch 410 is connected to the display signal line VIN, and a source electrode (S) is connected to one terminal of the capacitor 420 and an input terminal of the buffer amplifier 430. A gate electrode (G) of the switch 410 is connected to the signal line driving circuit 200 via a sample/hold driving signal line SH. The other terminal of the capacitor 420 is grounded. The common signal line driving circuit 400 samples and holds the display signal VIN in response to a sample/hold driving signal SH and generates a common signal VCOM as discussed later.

The scanning line driving circuit 500 applies scanning line signals (pulse signals) to the respective scanning lines SL in a line sequential manner at preset timings, in response to the vertical synchronizing signal VRST and the vertical clock signal VCLK, as discussed later.

The signal line driving circuit 200 applies sampling signals (pulse signals) to the respective sampling signal lines GS in a line sequential manner at the timings of application of the scanning signals to the respective scanning lines SL by the scanning line driving circuit 500, in response to the horizontal synchronizing signal HRST and the horizontal clock signal HCLK, as discussed later. The signal line driving circuit 200 also applies sample/hold driving signals (pulse signals) to the sample/hold driving signal line SH. The sampling circuit 300 and the signal line driving circuit 200 correspond to the signal line driving circuit of the present invention.

Figure 2:
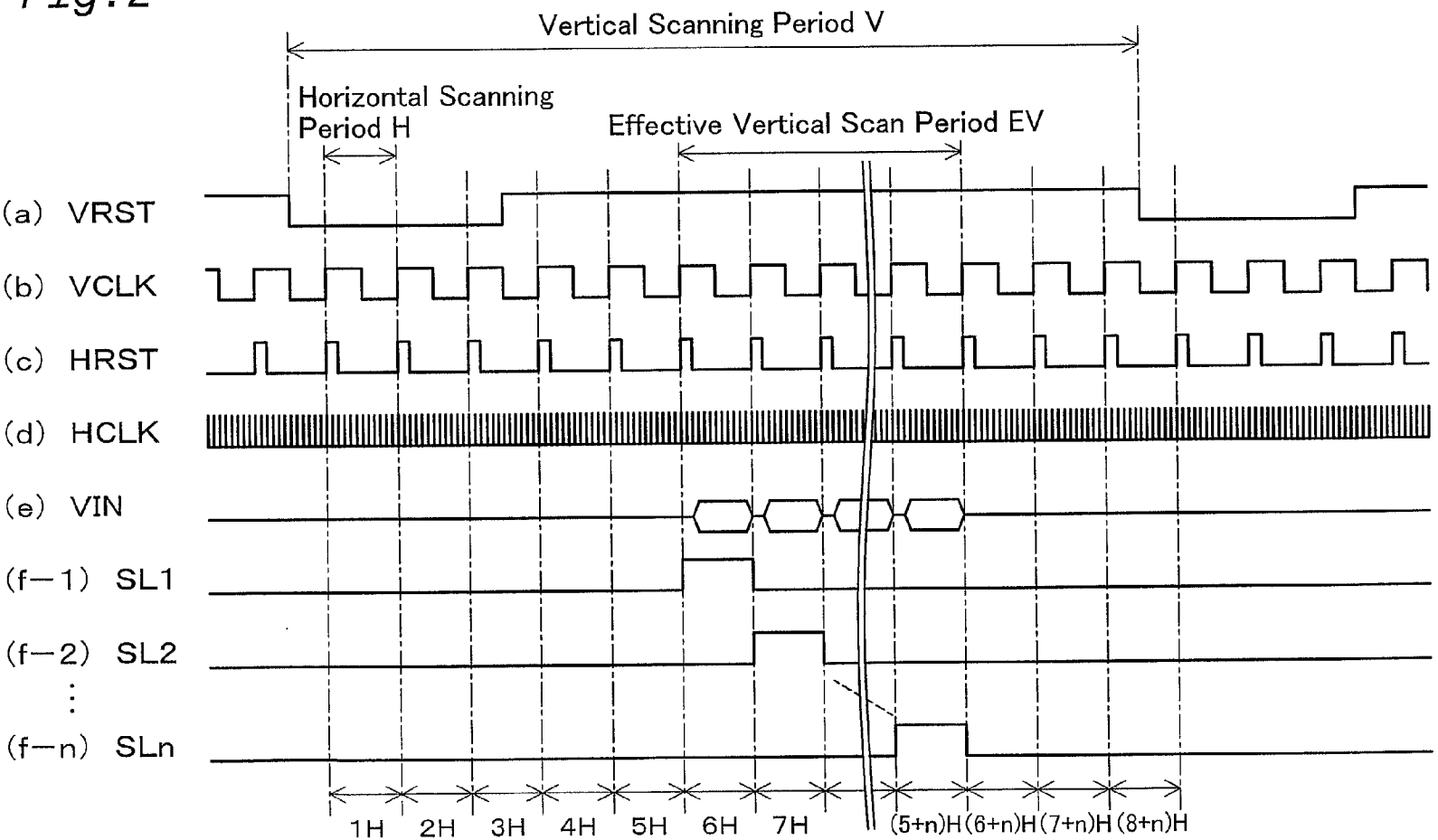
FIG. 2 is a timing chart showing operations of a scanning line driving circuit 500 included in the liquid crystal panel 10.

FIG. 2 is a timing chart showing operations of the scanning line driving circuit 500 included in the liquid crystal panel 10. The vertical synchronizing signal VRST, the vertical clock signal VCLK, the horizontal synchronizing signal HRST, and the horizontal clock signal HCLK as the timing signals are input at timings shown in FIGS. 2(*a*) through 2(*d*). The vertical synchronizing signal VRST shown in FIG. 2(*a*) is a periodic signal representing a start timing of vertical scanning. One period of the pulse signal starting from a falling edge represents a vertical scanning period (vertical scanning cycle) V for displaying one frame image.

The vertical clock signal VCLK shown in FIG. 2(*b*) is synchronous with the vertical synchronizing signal VRST and represents an activation timing of the scanning line driving circuit 500, that is, a driving period of each scanning line SL. In the specification hereof, the expression of 'synchronize' means that two signals vary with a fixed phase.

In the vertical clock signal VCLK, one period of the pulse signal starting from a rising edge represents a driving period of one scanning line SL, that is, a horizontal scanning period (horizontal scanning cycle) H. The vertical scanning period V is set to be equal to (8+n)-fold horizontal scanning period H, that is, a period (8+n)H. In the following description, the first horizontal scanning period, the second horizontal scanning period, . . . and the (8+n)-th horizontal scanning period are respectively referred to as '1H period', '2H period', and '(8+n)H period'.

The horizontal synchronizing signal HRST shown in FIG. 2(*c*) is a pulse signal rising at substantially the same timing as that of the vertical clock signal VCLK of FIG. 2(*b*). The horizontal synchronizing signal HRST is a periodic signal representing a start timing of horizontal scanning discussed later. The horizontal synchronizing signal HRST is generally set to have a narrower pulse width at high level, compared with the vertical clock signal VCLK.

The horizontal clock signal HCLK shown in FIG. 2(*d*) is synchronous with the horizontal synchronizing signal HRST and represents an activation timing of the signal line driving circuit 200, that is, a drive timing of each signal line DL, as described later. Either one of the vertical clock signal VCLK and the horizontal synchronizing signal HRST may be omitted.

Signals to be given to pixels actuated by the respective scanning lines SL are supplied as the display signal VIN in a time period EV from the 6H period to the (5+n)H period (hereinafter referred to as the 'effective vertical scan period') in each vertical scanning period V as shown in FIG. 2(*e*). The signal given as the display signal VIN is supplied synchronously with the horizontal synchronizing signal HRST and the horizontal clock signal HCLK discussed later.

The scanning line driving circuit 500 supplies high-level pulse signals as scanning line signals to the corresponding scanning lines SL (SL1 to SLn) in a line sequential manner in the respective horizontal scan periods 6H to (5+n)H of the effective vertical scan period EV as shown in FIGS. 2(*f*-1) through 2(*f*-n). The scanning line driving circuit 500 is readily constructed by a shift register, which utilizes the vertical clock signal VCLK as a shift clock.

Figure 3:
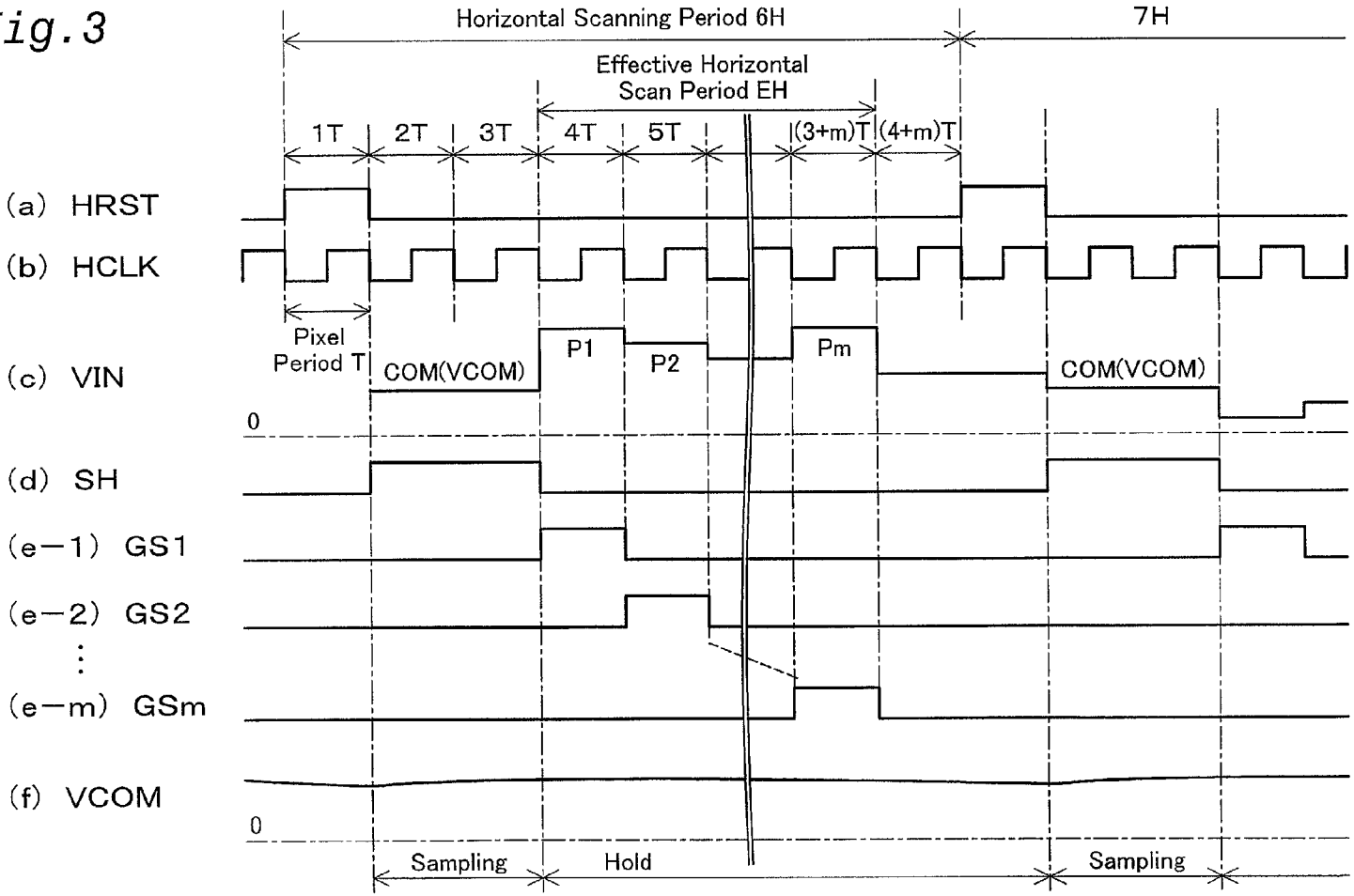
FIG. 3 is a timing chart showing operations of a signal line driving circuit 200 and a common signal line driving circuit 400 included in the liquid crystal panel 10.

FIG. 3 is a timing chart showing operations of the signal line driving circuit 200 and the common signal line driving circuit 400 included in the liquid crystal panel 10. This timing chart shows the 6H period, that is, the $6^{th}$ horizontal scanning period of FIG. 2. FIGS. 3(*a*) and 3(*b*) show the horizontal synchronizing signal HRST and the horizontal clock signal HCLK of FIGS. 2(*c*) and 2(*d*), respectively. FIG. 3(*c*) shows the display signal VIN of FIG. 2(*e*).

In the horizontal clock signal HCLK shown in FIG. 3(*c*), one period of the pulse signal starting from a falling edge represents a driving period of one signal line DL, that is, a pixel period T. The horizontal scanning period H is set to be equal to (4+m)-fold pixel period T, that is, a period (4+m)T. In the following description, the first pixel period, the second pixel period, . . . and the (4+m)-th pixel period are respectively referred to as '1T period', '2T period', . . . and '(4+m)T period'.

Signals P1 to Pm to be given to the respective signal lines DL (DL1 through DLm) are supplied as the display signal VIN synchronously with the horizontal clock signal HCLK in a time period EH from the 4T period to the (3+m)T period (hereinafter referred to as the 'effective horizontal scan period') as shown in FIG. 3(*c*).

A signal COM corresponding to the common signal VCOM is supplied as the display signal VIN synchronously with the horizontal clock signal HCLK in a time period from the 2T period to the 3T period (hereinafter referred to as the 'common signal generation period').

The signal line driving circuit 200 supplies a high-level pulse signal to the sample/hold driving signal line SH in the common signal generation period as shown in FIG. 3(*d*). The common signal line driving circuit 400 samples the level of the signal COM supplied as the display signal VIN and outputs the sampled signal level as the common signal VCOM as shown in FIG. 3(*f*). The common signal line driving circuit 400 functions to keep the common signal VCOM at the signal level specified by the sampled signal COM while the sample/hold driving signal SH is kept at the low level, that is, before the sample/hold driving signal SH rises to the high level.

As shown in FIGS. 3(*e*-1) through 3(*e*-m), the signal line driving circuit 200 supplies high-level pulse signals as sampling signals to the corresponding sampling signal lines GS (GS1 to GSm) in a line sequential manner in the respective pixel periods 4T to (3+m)T of the effective horizontal scan period EH. The signals P1 to Pm given to the display signal line VIN are supplied to the corresponding signal lines DL1 to DLm in a line sequential manner in each pixel period of the effective horizontal scan period EH. The signal line driving circuit 200 may readily be constructed by a shift register that utilizes the horizontal clock signal HCLK as a shift clock.

The above procedure activates the pixels PE connecting with the scanning lines SL and the signal lines DL selected by the scanning line driving circuit 500 and the signal line driving circuit 200. The display signal VIN supplied to the pixel PE in the active state via the sampling circuit 300 is applied to the pixel electrode 121 of the liquid crystal pixel 120. The common signal VCOM supplied via the common signal line driving circuit 400 is, on the other hand, applied to the common electrode 122 of the liquid crystal pixel 120. The liquid crystal pixel 120 works according to a potential difference between these two electrodes 121 and 122. Such activation enables an image to be displayed according to the supplied display signal in the image display module 100.

As described above, in this liquid crystal panel 10, the common signal line driving circuit 400 samples and holds the signal COM, which corresponds to the common signal VCOM and is supplied via the display signal input terminal VIN in the pixel periods 2T and 3T (the common signal generation period) immediately before the start of the effective horizontal scan period EH. This results in generating the common signal VCOM, which is to be supplied to each pixel PE. This liquid crystal panel 10 does not require a specifically provided input terminal, which is used in the prior art liquid crystal panel, to supply the common signal VCOM. This desirably reduces the total number of input terminals and thereby enhances the reliability of the device.

In the liquid crystal panel 10 of this embodiment, the two pixel periods 2T and 3T immediately before the effective horizontal scan period EH are set as the common signal generation period. Only one pixel period or a time period of three or greater pixel periods may alternatively be set as the common signal generation period. A time period immediately after the effective horizontal scan period EH may be set as the common signal generation period. Namely the common signal generation period may be set in an adequate time period except the effective horizontal scan period EH. The signal line driving circuit 200 of the liquid crystal panel 10 is constructed to output the sample/hold driving signal SH corresponding to the preset common signal generation period.

A2. Second Embodiment of Liquid Crystal Panel

Figure 4:
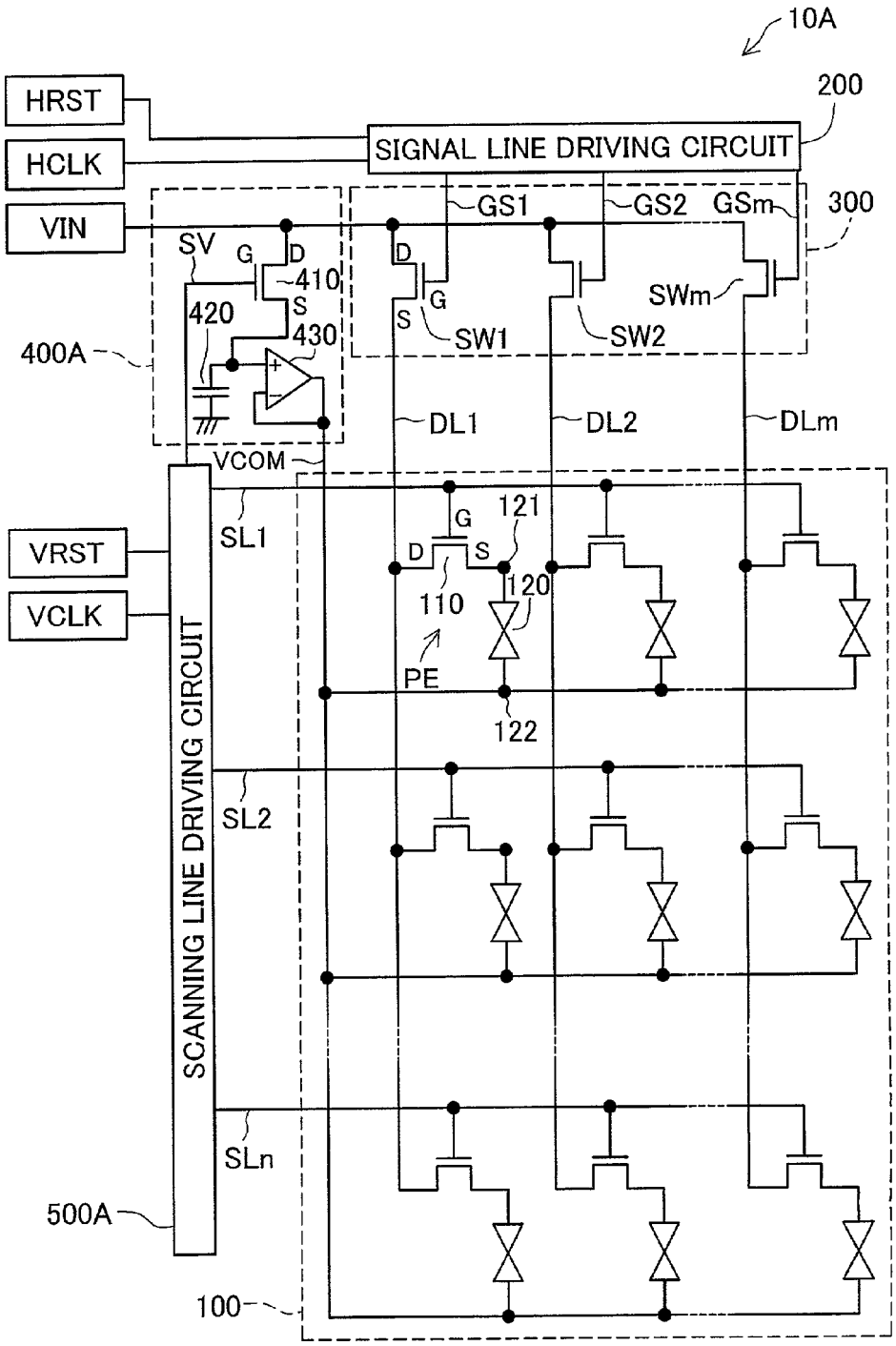
FIG. 4 is a circuit diagram schematically illustrating the electric structure of a liquid crystal panel 10A in a second embodiment of the present invention.

FIG. 4 is a circuit diagram schematically illustrating the electric structure of a liquid crystal panel 10A in a second embodiment of the present invention. The liquid crystal panel 10A is characterized by that a gate electrode (G) of a switch 410 included in a common signal line driving circuit 400A is connected to a scanning line driving circuit 500A via a sample/hold driving signal line SV, whereas the common signal line driving circuit 400 (FIG. 1) in the liquid crystal panel 10 of the first embodiment is connected to the signal line driving circuit 200 via the sample/hold driving signal line SH.

Figure 5:
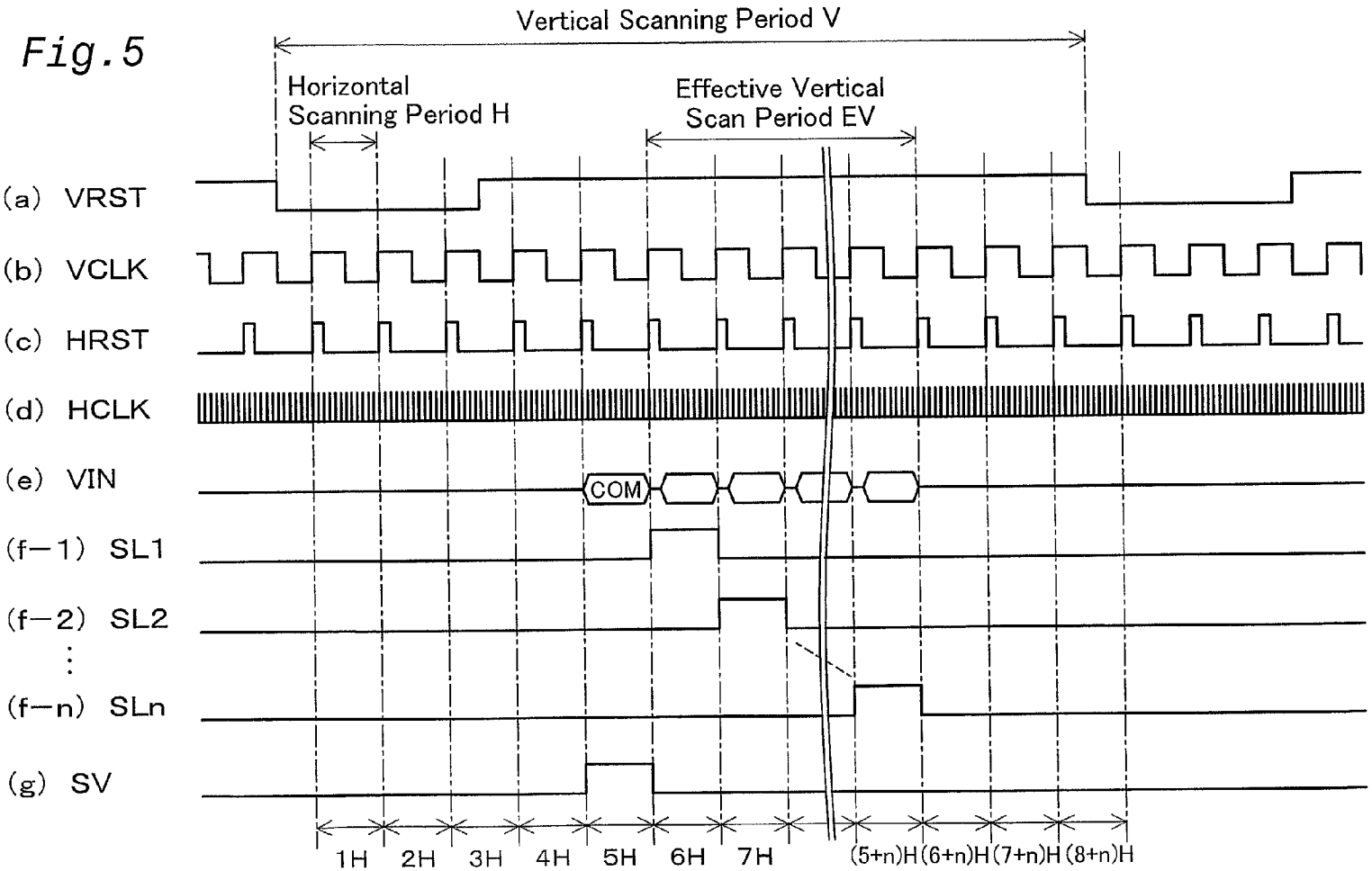
FIG. 5 is a timing chart showing operations of a scanning line driving circuit 500A included in the liquid crystal panel 10A.

FIG. 5 is a timing chart showing operations of the scanning line driving circuit 500A included in the liquid crystal panel 10A. FIGS. 5(*a*) through 5(*d*) and FIGS. 5(*f*-1) through 5(*f*-n) are identical with FIGS. 2(*a*) through 2(*d*) and FIGS. 2(*f*-1) through 2(*f*-n).

The scanning line driving circuit 500A supplies a high-level pulse signal to the sample/hold driving signal line SV shown in FIG. 5(*g*) in a horizontal scanning period 5H (common signal generation period) immediately before the start of the effective vertical scan period EV. The common signal line driving circuit 400A samples the level of the signal COM corresponding to the common signal VCOM supplied as the display signal VIN and holds the sampled signal level during the low signal level, thus generating the common signal VCOM.

In this manner, the liquid crystal panel 10A of this embodiment samples the level of the signal COM corresponding to the common signal VCOM supplied as the display signal VIN in the common signal generation period set immediately before the effective vertical scan period and thereby generates the common signal VCOM.

The liquid crystal panel 10A of this construction does not require a specifically provided input terminal, which is used in the prior art liquid crystal panel, to supply the common signal VCOM. This desirably reduces the total number of input terminals and thereby enhances the reliability of the device.

In the liquid crystal panel 10A of this embodiment, one horizontal scanning period 5H immediately before the effective vertical scan period EV is set as the common signal generation period. A time period of two or greater horizontal scanning periods may alternatively be set as the common signal generation period. A time period immediately after the effective vertical scan period EV may be set as the common signal generation period. Namely the common signal generation period may be set in an adequate time period except the effective vertical scan period EV. The scanning line driving circuit 500A of the liquid crystal panel 10A is constructed to output the sample/hold driving signal SV corresponding to the preset common signal generation period.

Figure 6:
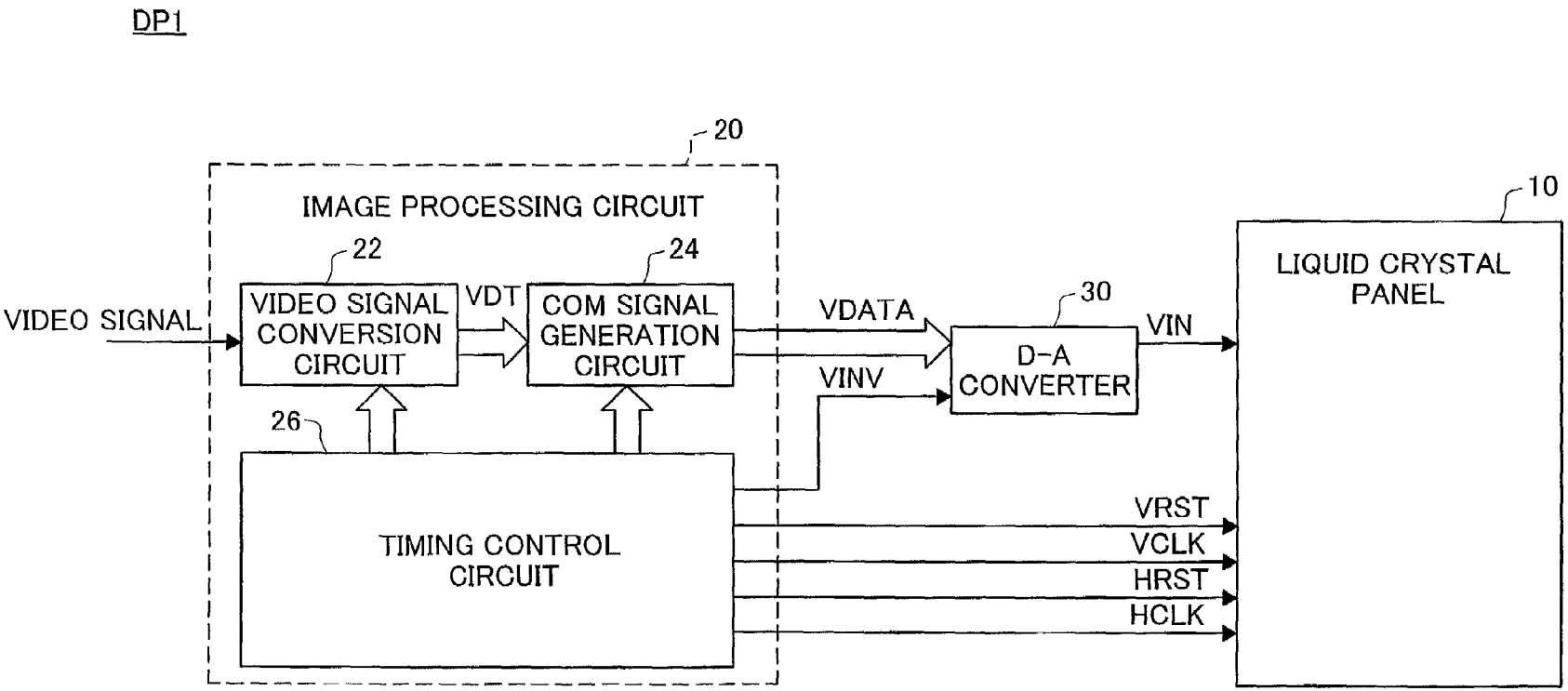
FIG. 6 is a block diagram schematically illustrating the construction of an image display apparatus DP1 with the liquid crystal panel 10 of the present invention applied thereto.

B. Construction and Operations of Image Display Apparatus with Liquid Crystal Panel B1. First Embodiment of Image Display Apparatus FIG. 6 is a block diagram schematically illustrating the construction of an image display apparatus DP1 with the liquid crystal panel 10 of the present invention applied thereto. The image display apparatus DP1 includes the liquid crystal panel 10, an image processing circuit 20, and a D-A converter 30. The image processing circuit 20 has a video signal conversion circuit 22, a COM signal generation circuit 24, and a timing control circuit 26. The timing control circuit 26 generates the timing signals supplied to the liquid crystal panel 10, that is, the vertical synchronizing signal VRST, the horizontal synchronizing signal HRST, the vertical clock signal VCLK, and the horizontal clock signal HCLK, as well as a polarity inversion signal VINV that controls the output polarity of the D-A converter 30 as discussed later. The timing control circuit 26 controls the operations of the video signal conversion circuit 22 and the COM signal generation circuit 24.

The video signal conversion circuit 22 converts a video signal supplied from an image supply apparatus (not shown), such as a personal computer or a video recorder, into a video signal of a specific timing that enables supply to the liquid crystal panel 10, and outputs the converted video signal. More concretely, the video signal conversion circuit 22 converts an analog video signal into digital video data and writes the converted digital video data into a frame memory (not shown) included in the video signal conversion circuit 22 synchronously with a synchronizing signal. The video signal conversion circuit 22 also reads the digital video data, which has been written in its frame memory, at specific timings that enable supply to the liquid crystal panel 10, that is, based on the timing signals VRST, HRST, VCLK, and HCLK generated by the timing control circuit 26. Diverse series of image processing are carried out in the writing and reading processes. In the case where the video signal supplied from the image supply apparatus is not an analog video signal but a digital video signal, the conversion of the analog video signal into the digital video data is omitted.

The COM signal generation circuit 24 combines the signal COM corresponding to the signal level to be supplied to the common signal line VCOM with the digital video signal VDT output from the video signal conversion circuit 22 to a composite signal and outputs the composite signal as a digital display signal VDATA.

The D-A converter 30 converts the digital display signal VDATA output from the image processing circuit 20 into an analog video signal and supplies the converted analog video signal as the display signal VIN to the liquid crystal panel 10. The polarity inversion signal VINV is supplied from the timing control circuit 26 to the D-A converter 30. As discussed later, the polarity of the output signal from the D-A converter 30 is inverted in response to the polarity inversion signal VINV output from the timing control circuit 26 synchronously with the vertical synchronizing signal VRST and the horizontal synchronizing signal HRST.

Figure 7:
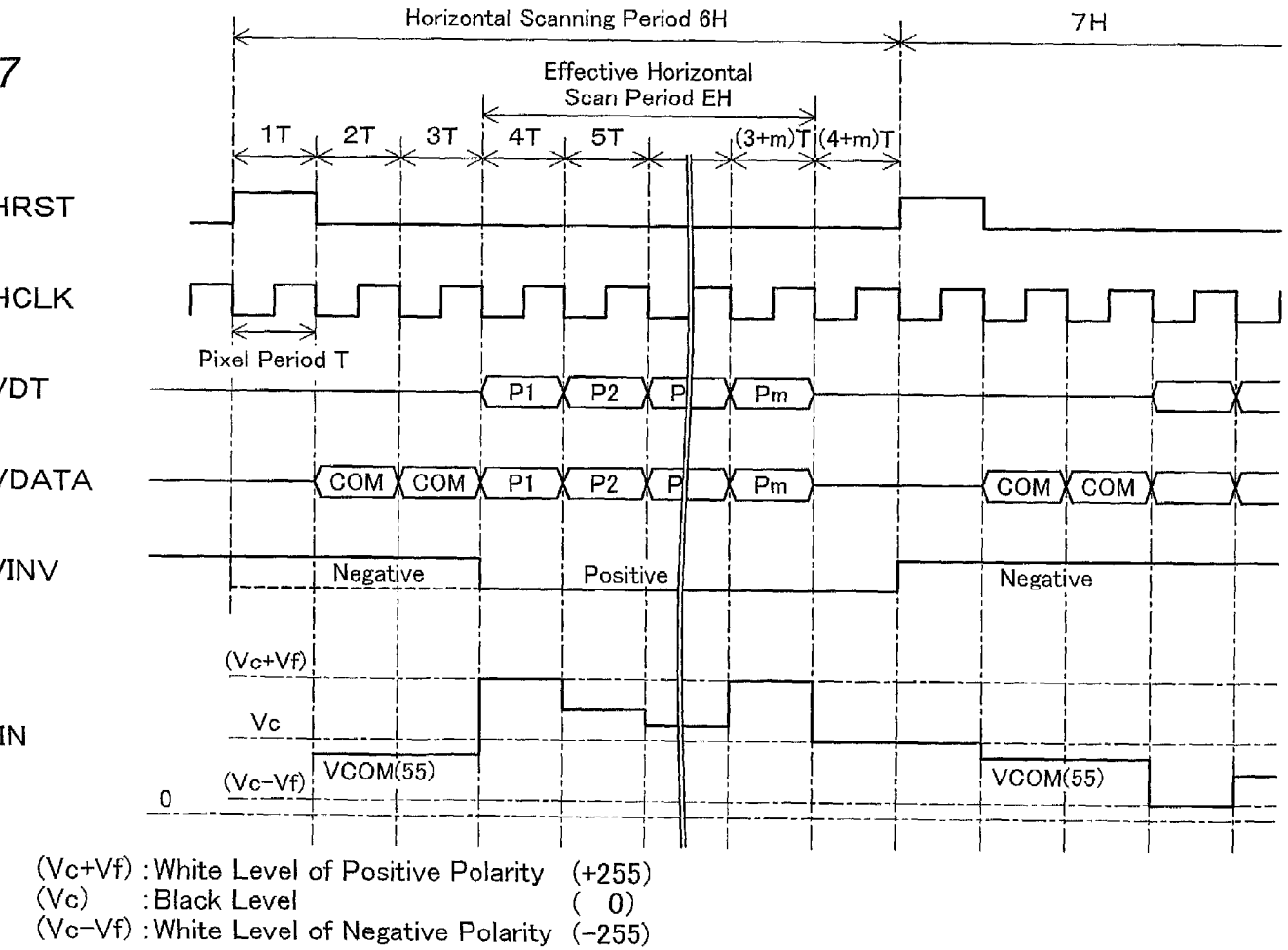
FIG. 7 is a timing chart showing a process of generating a display signal VIN supplied to the liquid crystal panel 10.

FIG. 7 is a timing chart showing a process of generating the display signal VIN supplied to the liquid crystal panel 10. This timing chart shows the first horizontal scanning period 6H in the effective vertical scan period EV shown in FIG. 2. The relation between the horizontal synchronizing signal HRST and the horizontal clock signal HCLK shown in FIGS. 7(*a*) and 7(*b*) is identical with the relation between FIGS. 3(*a*) and 3(*b*). The relations between the vertical synchronizing signal VRST, the vertical clock signal VCLK, the horizontal synchronizing signal HRST, the horizontal clock signal HCLK, and the display signal VIN in this embodiment are identical with those of FIG. 2 and are thus not specifically -illustrated or explained here. The other horizontal scanning periods included in the effective vertical scan period EV are identical with those of FIG. 2, except the timing of the polarity inversion signal VINV discussed later, and are thus not specifically described here.

The video signal conversion circuit 22 outputs pixel data P1 to Pm corresponding to respective pixel periods as the digital video signal VDT in the effective horizontal scan period EH (pixel periods 4T to (3+m)T) as shown in FIG. 7(*c*). The digital video signal VDT corresponds to the timing conversion signal of the present invention. The COM signal generation circuit 24 combines the signal COM representing the common signal VCOM with the digital video signal VDT to a composite signal in the pixel periods 2T and 3T (the common signal generation period) immediately before the effective horizontal scan period EH and outputs the composite signal as the digital display signal VDATA as shown in FIG. 7(*d*).

The timing control circuit 26 supplies the polarity inversion signal VINV, which repeats a high (negative) level and a low (positive) level in each horizontal scanning period as shown in FIG. 7(*e*), to the D-A converter 30. The polarity inversion signal VINV is controlled to keep the high (negative) level in the common signal generation period, because of the reason discussed below. In the horizontal scanning period 6H shown in FIG. 7(*e*), the polarity inversion signal VINV is expected to change its signal level from the high (negative) level to the low (positive) level at a rising timing of the horizontal synchronizing signal HRST. The polarity inversion signal VINV is, however, not changed to the low (positive) level but is kept at the high (negative) level during the pixel periods 1T to 3T.

The D-A converter 30 converts the digital display signal VDATA into an analog signal and outputs the converted analog signal as the analog display signal VIN as shown in FIG. 7(*f*). The D-A converter 30 inverts the polarity of its output according to the level of the polarity inversion signal VINV. The inversion follows the series of processing discussed below.

The video signal supplied to the video signal conversion circuit 22 represents 8-bit tone data; '0' represents the black level and '255' represents the white level. In the image display apparatus DP1 of this embodiment, the video signal conversion circuit 22 and the COM signal generation circuit 24 output the digital video signal VDT and the digital display signal VDATA as 8-bit tone data, which includes '0' representing the black level and '255' representing the white level. At the low (positive) level of the polarity inversion signal VINV, the D-A converter 30 outputs a center voltage Vc to the tone data '0' of the black level, while outputting a higher level voltage (Vc+Vf) than the center voltage Vc by a voltage Vf to the tone data '255' of the white level. At the high (negative) level of the polarity inversion signal VINV, on the other hand, the D-A converter 30 outputs he center voltage Vc to the tone data '0' of the black level, while outputting a lower level voltage (Vc−Vf) than the center voltage Vc by the voltage Vf to the tone data '255' of the white level. Namely the D-A converter 30 converts data of the digital display signal VDATA into the analog video signal VIN with the inverted polarity about the center voltage Vc, in response to the polarity inversion signal VINV.

Application of a DC voltage to liquid crystal forming the pixels for a long time deteriorates the liquid crystal. Inversion of the polarity of the display signal VIN suppresses the deterioration and extends the life of the liquid crystal panel. The inversion of the polarity is not restricted in the horizontal scanning period, but it is preferable to invert the polarity of the signal applied to the respective pixels in each frame period or vertical scanning period.

The polarity inversion signal VINV is not changed to the low (positive) level but is kept at the high (negative) level during the pixel periods 1T to 3T in the horizontal scanning period, in which the polarity inversion signal VINV is expected to change from the high (negative) level to the low (positive) level at a rising timing of the horizontal synchronizing signal HRST, because of the following reason. The level of the common signal VCOM is ideally set to be equal to the center voltage Vc of the display signal VIN. The actual level of the common signal VCOM is, however, generally lower than the center voltage Vc. The output of the D-A converter 30 is higher than the center voltage Vc at the low (positive) level of the polarity inversion signal VINV. In the case where the polarity inversion signal VINV is at the low (positive) level during the common signal generation period, the D-A converter 30 can not output the voltage corresponding to the actual level of the common signal VCOM. This is why the polarity inversion signal VINV is not changed to the low (positive) level but is kept at the high (negative) level during the pixel periods 1T to 3T in the horizontal scanning period, in which the polarity inversion signal VINV is expected to change from the high (negative) level to the low (positive) level at a rising timing of the horizontal synchronizing signal HRST, that is, the polarity inversion signal VINV is kept at the high (negative) level during the common signal generation period. In the image display apparatus DP1 of this embodiment, the level of the common signal VCOM is set equal to the tone data '55'.

In the image display apparatus DP1 of this embodiment, the timing control circuit 26 of the image processing circuit 20 generates the timing signals VRST, HRST, VCLK, and HCLK, which are to be supplied to the liquid crystal panel 10. The COM signal generation circuit 24 of the image processing circuit 20 outputs the signal COM, which represents the common signal VCOM during the common signal generation period, as the digital display signal VDATA. The D-A converter 30 then converts the digital display signal VDATA into the analog display signal VIN. Such arrangement completes the image display apparatus with the liquid crystal panel 10 applied thereto.

As clearly understood from the above description, the COM signal generation circuit 24 and the D-A converter 30 correspond to the display signal generation circuit of the present invention. The image processing circuit 20 and the D-A converter 30 correspond to the image processing device of the present invention.

In one possible application, the image display apparatus DP1 may be provided with a controller that controls the whole apparatus. The user may change (adjust) the value of the tone data specified by the signal COM generated by the COM signal generation circuit 24 of the image processing circuit 20 via the controller. This enables the level of the common signal VCOM to be readily adjusted in the liquid crystal panel 10. In this application, the controller corresponds to the adjustment control circuit of the present invention.

B2. Second Embodiment of Image Display Apparatus

Figure 8:
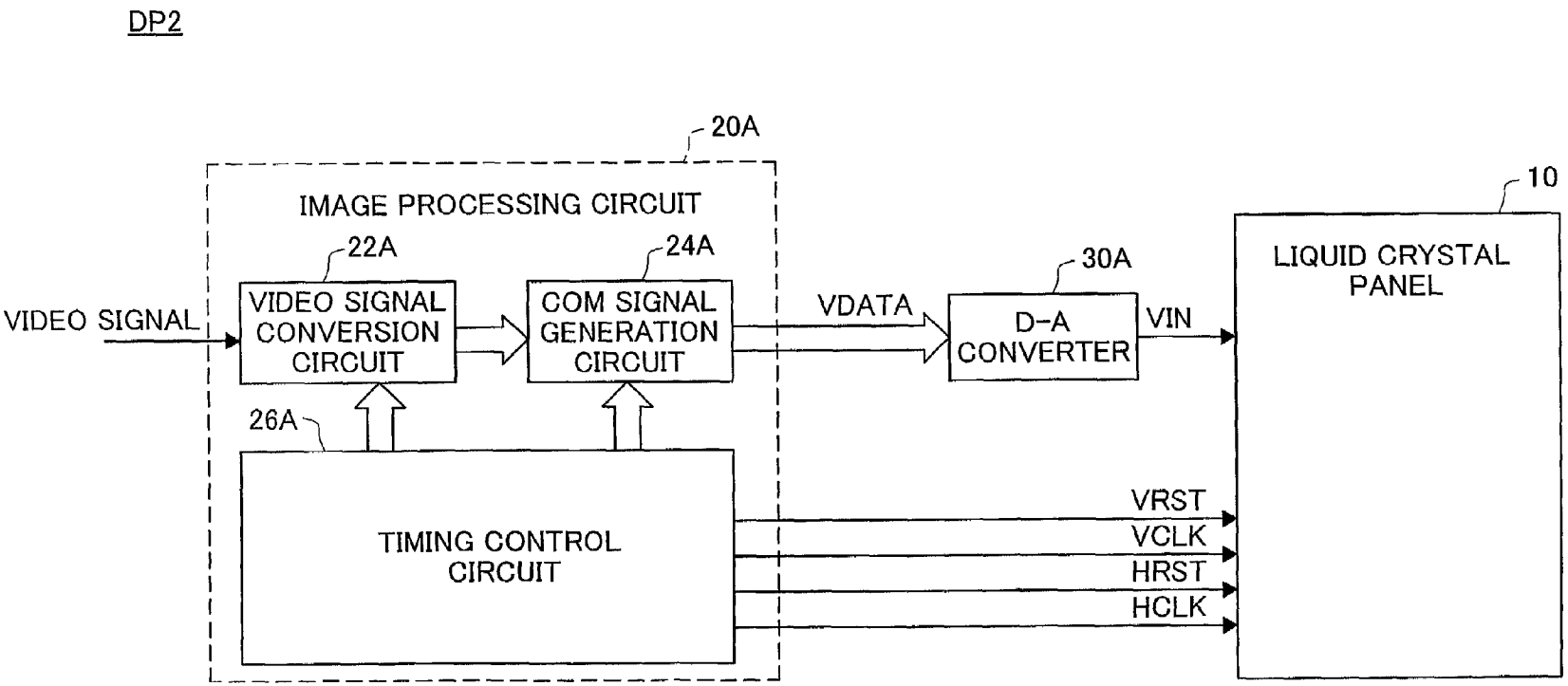
FIG. 8 is a block diagram schematically illustrating the construction of another image display apparatus DP2 with the liquid crystal panel 10 of the present invention applied thereto.

FIG. 8 is a block diagram schematically illustrating the construction of another image display apparatus DP2 with the liquid crystal panel 10 of the present invention applied thereto. The image display apparatus DP2 includes the liquid crystal panel 10, an image processing circuit 20A, and a D-A converter 30A. The image processing circuit 20A has a video signal conversion circuit 22A, a COM signal generation circuit 24A, and a timing control circuit 26A. The functions of the respective circuits 22A through 26A of the image processing circuit 20A and the D-A converter 30A are basically identical with those of the respective circuits 22 through 26 of the image processing circuit 20 and the D-A converter 30 (see FIG. 6). The following description focuses on the difference between the image display apparatus DP2 and the image display apparatus DP1.

Figure 9:
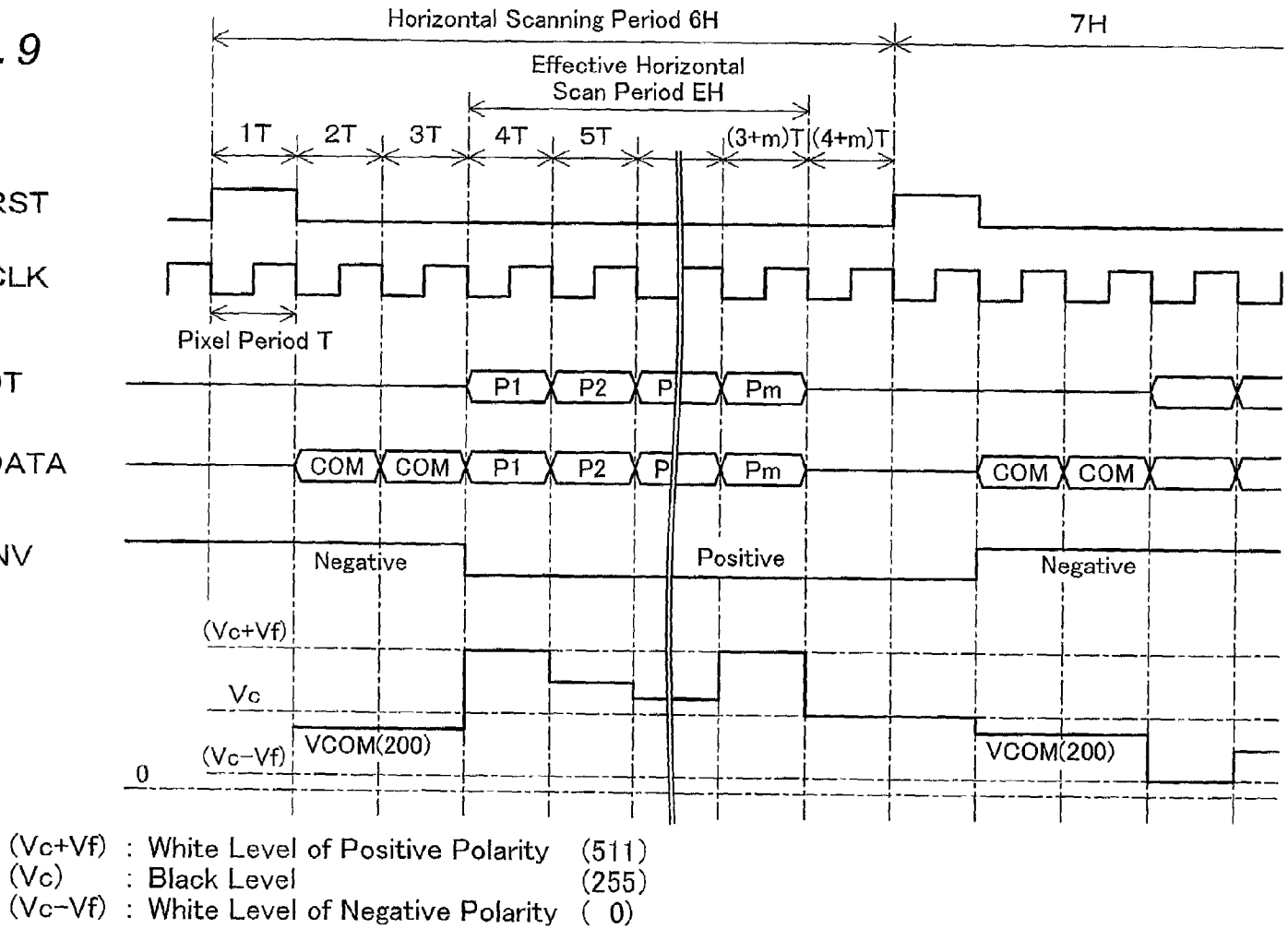
FIG. 9 is a timing chart showing a process of generating the display signal VIN supplied to the liquid crystal panel 10.

FIG. 9 is a timing chart showing a process of generating the display signal VIN supplied to the liquid crystal panel 10. Like the timing chart of FIG. 7, this timing chart shows the first horizontal scanning period 6H in the effective vertical scan period EV shown in FIG. 2. The relation between the horizontal synchronizing signal HRST and the horizontal clock signal HCLK shown in FIGS. 9(*a*) and 9(*b*) is identical with the relation between FIGS. 3(*a*) and 3(*b*). The relations between the vertical synchronizing signal VRST, the vertical clock signal VCLK, the horizontal synchronizing signal HRST, the horizontal clock signal HCLK, and the display signal VIN in this embodiment are identical with those of FIG. 2 and are thus not specifically illustrated or explained here.

The timings of the digital video signal VDT shown in FIG. 9(*c*) and the digital display signal VDATA shown in FIG. 9(*d*) are identical with those of FIGS. 7(*c*) and 7(*d*).

The values of the tone data output from the video signal conversion circuit 22A and the COM signal generation circuit 24A of the image processing circuit 20A in the image display apparatus DP2 of this embodiment are different from the tone data output from the video signal conversion circuit 22 and the COM signal generation circuit 24 of the image processing circuit 20 in the image display apparatus DP1 of the first embodiment, as discussed below.

The video signal supplied to the video signal conversion circuit 22A is 8-bit tone data, which includes '0' representing the black level and '255' representing the white level. In the image display apparatus DP2 of this embodiment, the video signal conversion circuit 22A outputs the digital video signal VDT and the digital display signal VDATA as 9-bit tone data. More specifically, the video signal conversion circuit 22A sets '255' to the tone data of the black level and '511' to the tone data of the white level, in the case of no inversion of the polarity of the display signal. In the case of inversion of the polarity of the display signal, on the other hand, the video signal conversion circuit 22A sets '255' to the tone data of the black level and '0' to the tone data of the white level. The COM signal generation circuit 24A correspondingly outputs the tone data representing the common signal VCOM as 9-bit data. In this embodiment, the level of the common signal VCOM is set equal to the tone data of '200'.

The D-A converter 30A converts the 9-bit digital video signal VDATA output from the image processing circuit 20A into the analog display signal VIN. The tone data '255' corresponding to the black level is accordingly converted to the center voltage Vc, while the tone data '511' corresponding to the white level of the positive polarity and the tone data '0' corresponding to the white level of the negative polarity are respectively converted to a voltage (Vc+Vf) and a voltage (Vc−Vf). The image processing circuit 20A and the D-A converter 30A thus generate the display signal VIN, which is to be supplied to the liquid crystal panel 10, in the same manner as that of the image processing circuit 20 and the D-A converter 30.

In the image display apparatus DP2 of this embodiment, the timing control circuit 26A of the image processing circuit 20A generates the timing signals VRST, HRST, VCLK, and HCLK, which are to be supplied to the liquid crystal panel 10. The COM signal generation circuit 24A of the image processing circuit 20A outputs the signal COM, which represents the common signal VCOM during the common signal generation period, as the digital display signal VDATA. The D-A converter 30A then converts the digital display signal VDATA into the analog display signal VIN. Such arrangement completes the image display apparatus with the liquid crystal panel 10 applied thereto.

As clearly understood from the above description, the COM signal generation circuit 24A and the D-A converter 30A correspond to the display signal generation circuit of the present invention. The image processing circuit 20A and the D-A converter 30A correspond to the image processing device of the present invention.

Like the image display apparatus DP1 of the first embodiment, in one possible application, this image display apparatus DP2 may be provided with a controller that controls the whole apparatus. The user may change (adjust) the value of the tone data specified by the signal COM generated by the COM signal generation circuit 24A of the image processing circuit 20A via the controller. This enables the level of the common signal VCOM to be readily adjusted in the liquid crystal panel 10.

C. Modifications

The present invention is not restricted to the above embodiments or their applications, but there may be many other modifications, changes, and alterations without departing from the scope or spirit of the main characteristics of the present invention. Some examples of possible modification are given below.

The image display apparatuses DP1 and DP2 of the above embodiments include the liquid crystal panel 10 of the first embodiment, although they may include the liquid crystal panel 10A of the second embodiment instead. In the image display apparatus with the liquid crystal panel 10A, the COM signal generation circuit of the image processing circuit generates the signal COM representing the common signal VCOM during the common signal generation period corresponding to the liquid crystal panel 10A.

The above embodiments regard the image display apparatuses that display images supplied from an external image supply apparatus, as the electronic apparatus with the liquid crystal panel 10 of the present invention applied thereto. The technique of the present invention is, however, not restricted to these embodiments, but may be applicable to diverse electronic equipment including an image processing apparatus, a D-A converter, and a liquid crystal panel.

What is claimed is:

1. A liquid crystal device having multiple pixels, the liquid crystal device comprising:

an input terminal that receives a display signal including a predetermined signal used for generating a common signal and multiple pixel signals to be supplied to the multiple pixels, wherein the predetermined signal is embedded into a predetermined period between a group of pixel signals and another group of pixel signals in the display signal, and the common signal is to be commonly supplied to the multiple pixels;

a common signal line that is commonly connected to the multiple pixels; and a common signal line driving circuit that generates the common signal in response to the predetermined signal included in the display signal input from the input terminal and supplies the generated common signal to the common signal line, wherein the predetermined period is part of a horizontal scanning period except an effective horizontal scan period, and wherein the common signal line driving circuit is a sample/hold circuit that samples the predetermined signal included in the display signal input from the input terminal and outputs the predetermined sampled signal as the common signal.

2. A liquid crystal device in accordance with claim 1, the liquid crystal device further comprising:

multiple rows of scanning lines and multiple columns of signal lines for selecting the multiple pixels;

a scanning line driving circuit that supplies scanning signals to the corresponding multiple rows of scanning lines in a sequence of the multiple rows of scanning lines; and a signal line driving circuit that samples display signals corresponding to the multiple columns of signal lines in a sequence of the multiple columns of signal lines and supplies the sampled display signals to the corresponding signal lines, wherein the signal line driving circuit supplies a sample/hold signal, which is used for sampling the predetermined signal, to the common signal line driving circuit.

3. A liquid crystal device in accordance with claim 1, the liquid crystal device further comprising:

multiple rows of scanning lines and multiple columns of signal lines for selecting the multiple pixels;

a scanning line driving circuit that supplies scanning signals to the corresponding multiple rows of scanning lines in a sequence of the multiple rows of scanning lines; and a signal line driving circuit that samples display signals corresponding to the multiple columns of signal lines in a sequence of the multiple columns of signal lines and supplies the sampled display signals to the corresponding signal lines, wherein the scanning line driving circuit supplies a sample/hold signal, which is used for sampling the predetermined signal, to the common signal line driving circuit.

4. A liquid crystal device having multiple pixels, the liquid crystal device comprising:

an input terminal that receives a display signal including a predetermined signal used for generating a common signal and multiple pixel signals to be supplied to the multiple pixels, wherein the predetermined signal is embedded into a predetermined period between a group of pixel signals and another group of pixel signals in the display signal, and the common signal is to be commonly supplied to the multiple pixels;

a common signal line that is commonly connected to the multiple pixels;

a common signal line driving circuit that generates the common signal in response to the predetermined signal included in the display signal input from the input terminal and supplies the generated common signal to the common signal line, wherein the predetermined period is part of a vertical scanning period except an effective vertical scan period, and wherein the common signal line driving circuit is a sample/hold circuit that samples the predetermined signal included in the display signal input from the input terminal and outputs the predetermined sampled signal as the common signal.

5. A liquid crystal device in accordance with claim 4, the liquid crystal device further comprising:

multiple rows of scanning lines and multiple columns of signal lines for selecting the multiple pixels;

a scanning line driving circuit that supplies scanning signals to the corresponding multiple rows of scanning lines in a sequence of the multiple rows of scanning lines; and a signal line driving circuit that samples display signals corresponding to the multiple columns of signal lines in a sequence of the multiple columns of signal lines and supplies the sampled display signals to the corresponding signal lines, wherein the signal line driving circuit supplies a sample/hold signal, which is used for sampling the predetermined signal, to the common signal line driving circuit.

6. A liquid crystal device in accordance with claim 4, the liquid crystal device further comprising:

multiple rows of scanning lines and multiple columns of signal lines for selecting the multiple pixels;

a scanning line driving circuit that supplies scanning signals to the corresponding multiple rows of scanning lines in a sequence of the multiple rows of scanning lines; and a signal line driving circuit that samples display signals corresponding to the multiple columns of signal lines in a sequence of the multiple columns of signal lines and supplies the sampled display signals to the corresponding signal lines, wherein the scanning line driving circuit supplies a sample/hold signal, which is used for sampling the predetermined signal, to the common signal line driving circuit.

7. An image display apparatus, comprising:

a liquid crystal device having multiple pixels; and an image processing device that generates a display signal, which is to be input into the liquid crystal device, the liquid crystal device comprising:

an input terminal that receives the display signal including a predetermined signal used for generating a common signal and multiple pixel signals to be supplied to the multiple pixels, wherein the predetermined signal is embedded into a predetermined period between a group of pixel signals and another group of pixel signals in the display signal, and the common signal is to be commonly supplied to the multiple pixels, the image processing device comprising:

a video signal conversion circuit that converts an input video signal and generates the multiple pixel signals, which are to be given to the multiple pixels of the liquid crystal device; and a display signal generation circuit that combines the multiple pixel signals with a predetermined signal, which is used for generating a common signal to be commonly supplied to the multiple pixels, and thereby generates one display signal.

8. An image display apparatus in accordance with claim 7, wherein the image processing device further comprises:

an adjustment control circuit that adjusts a value of data included in the predetermined signal.

9. A liquid crystal device having multiple pixels, the liquid crystal device comprising:

an input terminal that receives a display signal including a predetermined signal used for generating a common signal and multiple pixel signals to be supplied to the multiple pixels, wherein the predetermined signal is embedded into a predetermined period between a group of pixel signals and another group of pixel signals in the display signal, and the common signal is to be commonly supplied to the multiple pixels;

a common signal line that is commonly connected to the multiple pixels; and a common signal line driving circuit that generates the common signal in response to the predetermined signal included in the display signal input from the input terminal and supplies the generated common signal to the common signal line, wherein the common signal line driving circuit is a sample/hold circuit that samples the predetermined signal included in the display signal input from the input terminal and outputs the predetermined sampled signal as the common signal.

10. A liquid crystal device in accordance with claim 9, the liquid crystal device further comprising:

multiple rows of scanning lines and multiple columns of signal lines for selecting the multiple pixels;

a scanning line driving circuit that supplies scanning signals to the corresponding multiple rows of scanning lines in a sequence of the multiple rows of scanning lines; and a signal line driving circuit that samples display signals corresponding to the multiple columns of signal lines in a sequence of the multiple columns of signal lines and supplies the sampled display signals to the corresponding signal lines, wherein the signal line driving circuit supplies a sample/hold signal, which is used for sampling the predetermined signal, to the common signal line driving circuit.

11. A liquid crystal device in accordance with claim 9, the liquid crystal device further comprising:

multiple rows of scanning lines and multiple columns of signal lines for selecting the multiple pixels;

a scanning line driving circuit that supplies scanning signals to the corresponding multiple rows of scanning lines in a sequence of the multiple rows of scanning lines; and a signal line driving circuit that samples display signals corresponding to the multiple columns of signal lines in a sequence of the multiple columns of signal lines and supplies the sampled display signals to the corresponding signal lines, wherein the scanning line driving circuit supplies a sample/hold signal, which is used for sampling the predetermined signal, to the common signal line driving circuit.

* * * * *